US006045177A

United States Patent [19]

Grace

[11] Patent Number: 6,045,177

[45] Date of Patent: Apr. 4, 2000

[54] PORTABLE COLLAPSIBLE CHAIR

[76] Inventor: Daniel R. Grace, 11 Goodrich Ave., Cromwell, Conn. 06416

[21] Appl. No.: 09/114,816

[22] Filed: Jul. 13, 1998

[51] Int. Cl.[7] ..... A47C 4/28

[52] U.S. Cl. ..... 297/45; 297/183.5

[58] Field of Search ..... 297/16.1, 16.2, 297/45, 42, 183.1, 183.5

[56] References Cited

U.S. PATENT DOCUMENTS

| | | |
|---|---|---|
| 2,691,410 | 10/1954 | Boucher . |
| 3,124,387 | 3/1964 | Maclaren . |
| 3,136,272 | 6/1964 | Sprigman . |
| 3,635,520 | 1/1972 | Roher et al. . |
| 4,807,930 | 2/1989 | Helfrich . |
| 4,826,241 | 5/1989 | Barras . |

FOREIGN PATENT DOCUMENTS

| | | | |
|---|---|---|---|
| 513265 | 3/1954 | Belgium | 297/45 |

*Primary Examiner*—Milton Nelson, Jr.
*Attorney, Agent, or Firm*—McCormick, Paulding & Huber LLP

[57] ABSTRACT

A portable collapsible chair having an articulated frame formed by a plurality of X-shaped linkages consecutively positioned adjacent one another and pivotally connected to move from a seating position to a collapsed or carrying position in response to lifting movement applied to a carrying strap connected to the frame to bring the strap to a shoulder carrying position. In the collapsed or carrying position the various rigid elongated members which comprise the chair frame form a compact bundle and extend in a single generally longitudinally extending direction.

21 Claims, 5 Drawing Sheets

PORTABLE COLLAPSIBLE CHAIR

FIELD OF INVENTION

This invention relates in general to chairs and seats.

BACKGROUND OF THE INVENTION

The present invention deals particularly with an improved portable spectator chair of the type having an articulated frame including a plurality of X-shaped cross-members formed by rigid elongated members and collapsible to a compact bundle wherein all of the elongated members extend in a single longitudinal direction. Portable collapsible spectator chairs of the aforedescribed general type are well known in the art and are often provided with a carrying bag or sleeve into which the collapsed chair may be packed to facilitate hand carrying. However, the aforedescribed method of portability requires several manual steps to collapse, pack, unpack and set up the chair. Such a chair is not particularly suitable for use in viewing a sports activity which requires the spectator to move frequently to follow the action, as, for example, a golf tournament. Further, the carrying bag or sleeve generally comprises excess baggage and when not in use may easily be left behind or otherwise lost in the course of spectator movement. If the carrying bag or sleeve is designed to be carried by a handle a further problem may arise where the chair and several other items are to be transported a substantial distance from a remote parking place.

Accordingly, it is the general aim of the present invention to provide an improved chair of the aforedescribed general type which includes an integral shoulder carrying strap, thereby eliminating the need for a separate carrying bag or sleeve. It is a further aim of the present invention to provide an improved portable collapsible chair having an integral shoulder carrying strap which also serves as a means for rapidly collapsing the chair from a normal setup or seating position to a carrying position. Yet another aim of the invention is to provide an improved portable collapsible chair having an integral carrying strap which is deployed in out-of-the-way position when the chair is in a normal seating position and which extends to shoulder carrying length for convenient shoulder carrying when the chair is moved from its normal seating position to its collapsed or carrying position.

SUMMARY OF THE INVENTION

In accordance with the present invention, a portable collapsible chair has a frame including at least 3 X-shaped linkages consecutively positioned adjacent one another and which include a rear linkage and a pair of side linkages. Each of the linkages has pair of rigid elongated link members. The link members of each pair are connected to each other at a crossing point or central axis of the pair for pivotal movement relative to each other about the central axis. Each of the members has a lower portion terminating at a lower end and an upper portion terminating at an upper end. Lower supporting means are provided for connecting adjacent lower ends of consecutive linkages for pivotal movement relative to each other. Upper supporting means are provided for connecting adjacent upper ends of consecutive linkages for pivotal movement relative to each other. The chair has a set up position wherein it rests upon a generally horizontally disposed supporting surface with the seat supported in a generally horizontally disposed position and a collapsed position wherein the chair forms a compact bundle with each of the rigid elongated members generally extending in a single longitudinal direction. In accordance with the invention, a carrying means is provided for moving the chair from its set up position to its collapsed or carrying position, maintaining the chair in its collapsed position, and carrying the chair in its collapsed position. The carrying means includes an elongated carrying strap having strap end portions connected to the side linkages. The carrying strap extends rearwardly beyond the chair frame and has a strap central portion disposed rearwardly of the chair frame. Portions of the carrying strap are engageable with the link members of the rear linkage in response to an upwardly directed force applied to the strap central portion whereby the chair is moved from its set-up position to its collapsed position to be carried on a shoulder by the carrying strap.

DETAILED DESCRIPTION OF PREFERRED EMBODIMENTS

Figure 2:
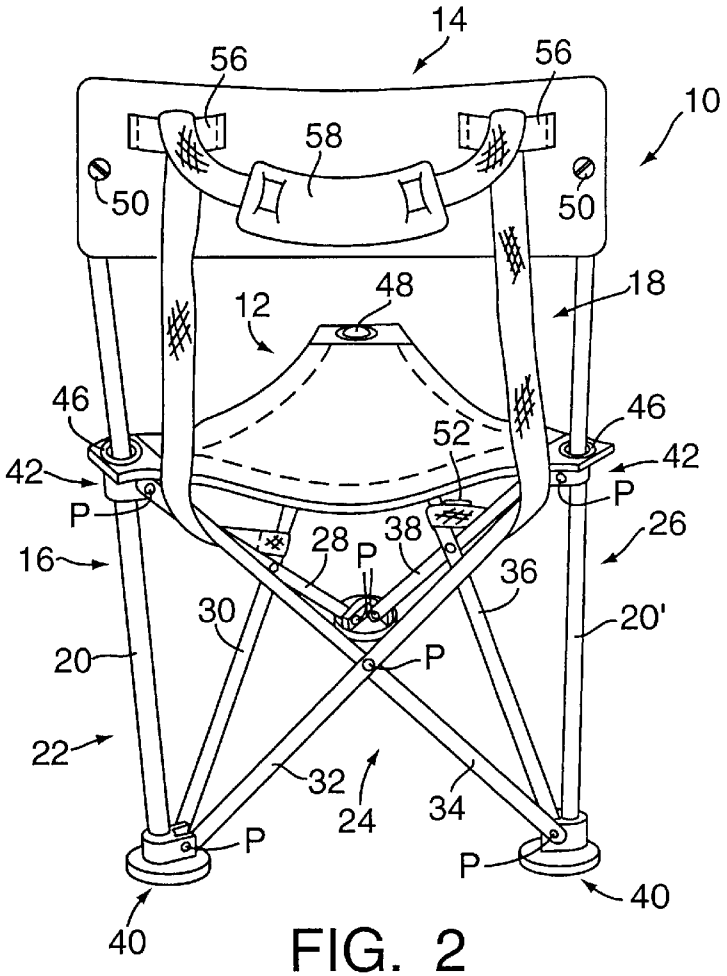
FIG. 2 is a rear perspective view of the chair shown in FIG. 1.
Figure 1:
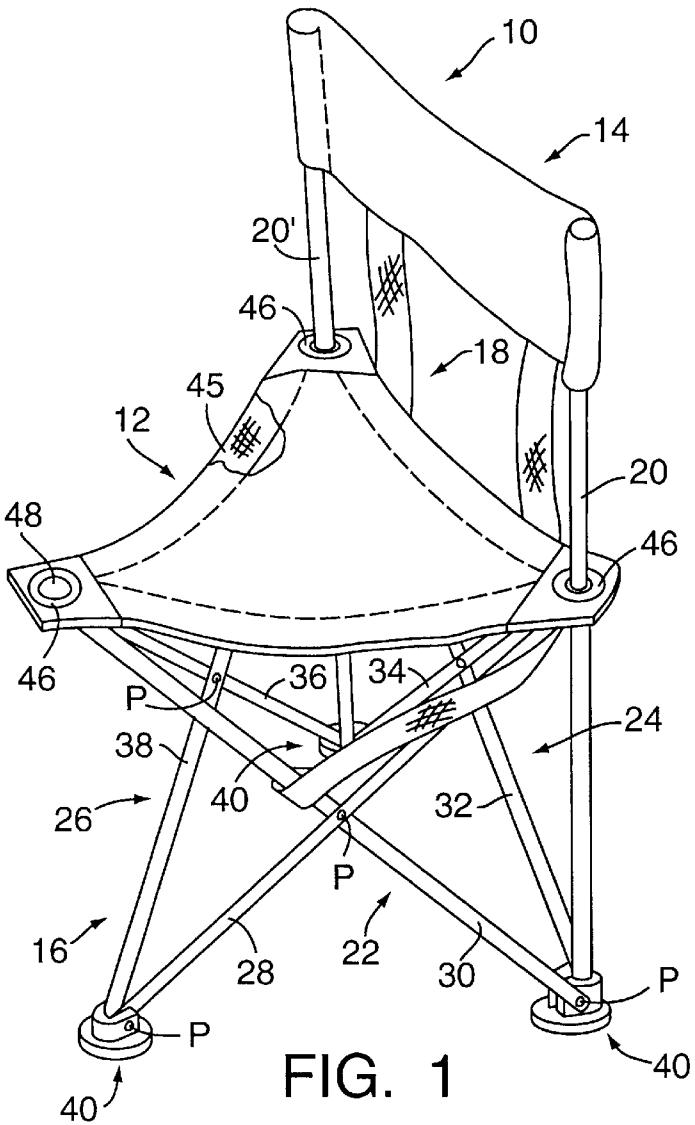
FIG. 1 is a perspective view of a portable collapsible chair embodying the present invention.
Figure 3:
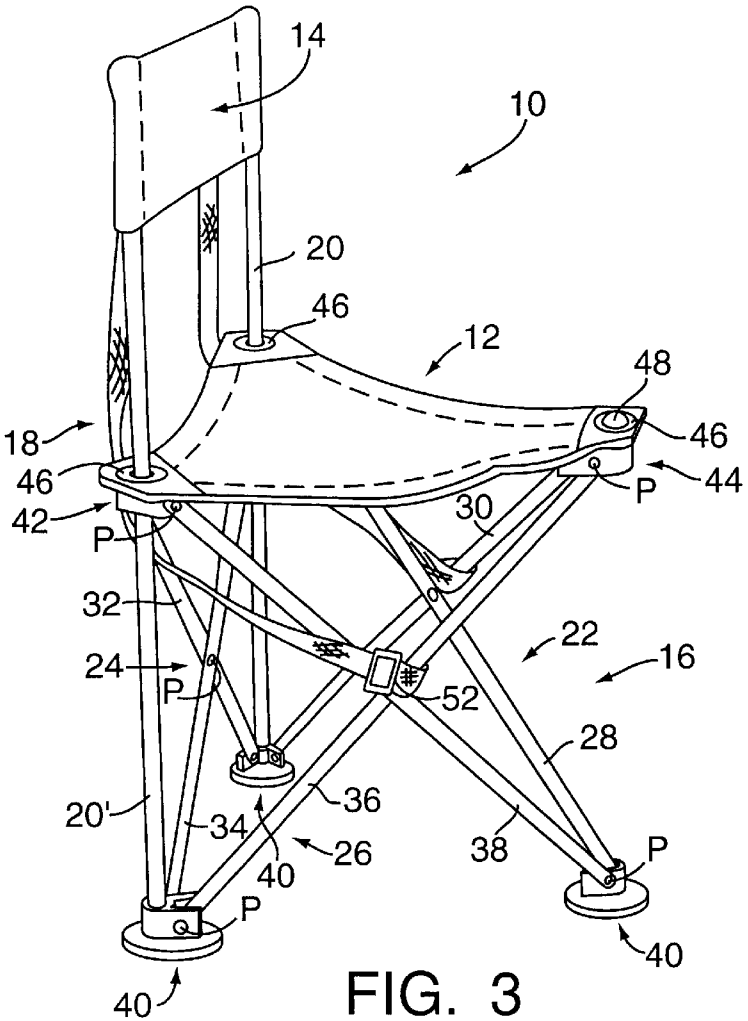
FIG. 3 is another perspective view of the chair shown in FIG. 1

Turning now to the drawings and referring first particularly to FIGS. 1–3, a portable collapsible chair embodying the present invention is indicated generally by the reference numeral 10. The illustrated chair 10 has a seat and a backrest designated generally by the numerals 12 and 14, respectively. The seat and backrest are supported by an articulated chair frame designated generally by the numeral 16 and formed from a plurality of rigid elongated frame members pivotally connected to each other. The chair has a setup or seating position wherein the chair frame 16 normally rests upon a generally horizontal supporting surface and supports the seat 12 in a generally horizontally disposed position and the backrest 14 in a generally vertically disposed position. In accordance with the present invention, a carrying strap indicated generally by the numeral 18 and secured to the chair frame 16 is operative to move the chair 10 from its setup or normal seating position to a collapsed or carrying position wherein the various rigid elongated frame members form a compact bundle and extend in a single generally longitudinally extending direction, all of which will be hereinafter further discussed.

Considering now the chair 10 in more detail and further referring particularly to FIGS. 1–3, the articulated frame 16 is preferably formed from a plurality of axially elongated or tubular rods pivotally connected to each other for movement between the setup or seating position and the collapsed or carrying position, as will be hereinafter more fully described. The frame has a pair of elongated laterally spaced apart and generally axially parallel rear members 20, 20' which extend in generally axially vertical directions when the chair is resting on a substantially horizontal supporting surface in its setup position. Each rear member 20, 20' has a lower portion which defines a rear leg and an upper portion which forms an upward extension of a lower or leg portion, terminates above the chair seat 12, and defines a chair backrest support.

The chair frame 16 further includes at least 3 substantially identical generally X-shaped linkages consecutively positioned adjacent one another. The linkages include a first side linkage, indicated generally at 22, a rear linkage, designated generally by the numeral 24, and a second side linkage, shown at 26. Each of the linkages 22–26 comprises a pair of rigid link members or axially elongated tubular rods centrally connected for pivotal movement relative to each other about a generally horizontally disposed central pivotal axis defined by a pivot pin or rivet P which secures the two link members in connected relation to each other. Thus, the first side linkage 22 includes the pivotally connected link members or links 28 and 30, the rear linkage 24 is formed by the links 32 and 34 and the second side linkage 26 includes the connected links 36 and 38. Each of the links 28–38 has an upper portion, that is a portion located above its central pivot axis P, and a lower portion disposed below its central pivot axis.

Figure 6:
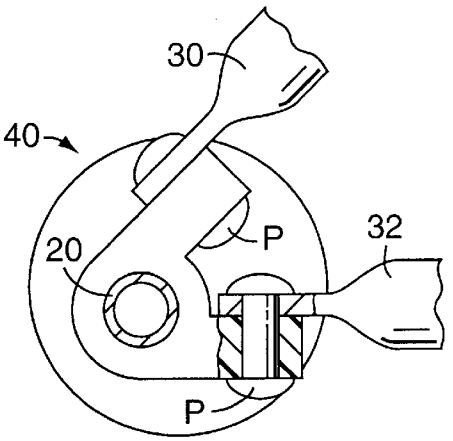
FIG. 6 is a fragmentary top plan view of the chair rear foot assembly of FIG. 4.
Figure 5:
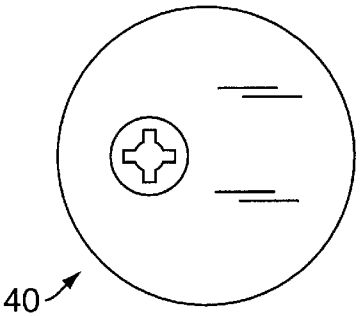
FIG. 5 is a fragmentary bottom plan view of the chair rear foot assembly shown in FIG. 4.
Figure 4:
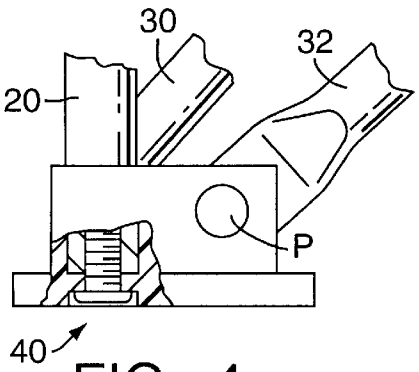
FIG. 4 is a somewhat enlarged fragmentary rear elevational view of a chair rear foot assembly.

The adjacent lower ends of the consecutively positioned linkages 22, 24 and 26 are pivotally connected by pivot pins or rivets P, P to feet indicated generally at 40, 40. Thus, the lower ends of the various adjacent links are connected to each other, each foot 40 providing pivotal connection between the lower ends of two adjacent link members. A typical chair rear foot 40 which is fastened to the lower end of the rear frame member 20 and provides connection between links 30 and 32 is shown in FIGS. 4–6.

Figure 9:
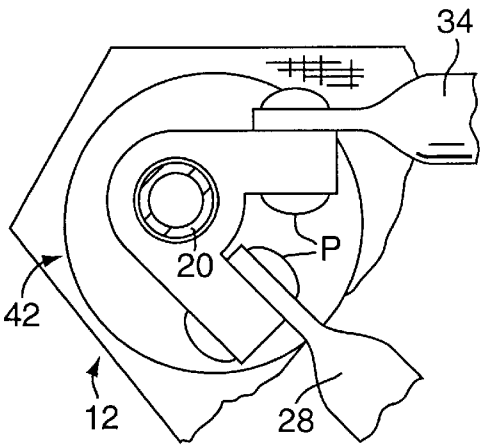
FIG. 9 is a fragmentary bottom plan view of the seat rear support assembly shown in FIG. 7.
Figure 8:
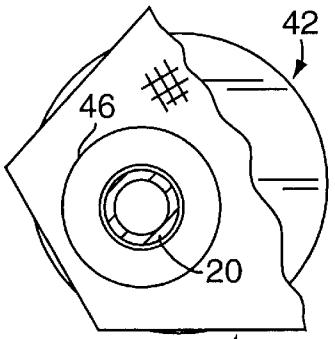
FIG. 8 is a fragmentary top plan view of the seat rear support assembly shown in FIG. 7.
Figure 7:
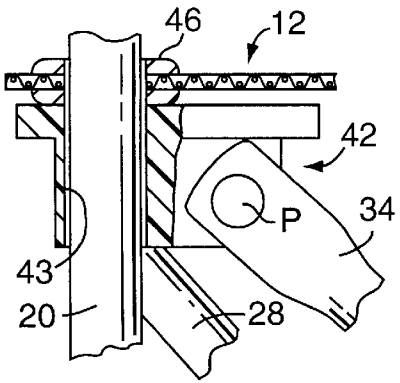
FIG. 7 is somewhat enlarged fragmentary rear elevational view of a seat rear support assembly.
Figure 11:
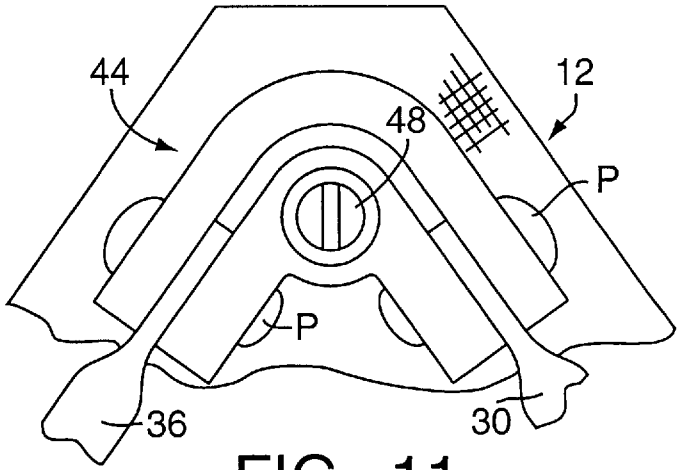
FIG. 11 is a fragmentary bottom plan view of the seat front support assembly shown in FIG. 10.
Figure 10:
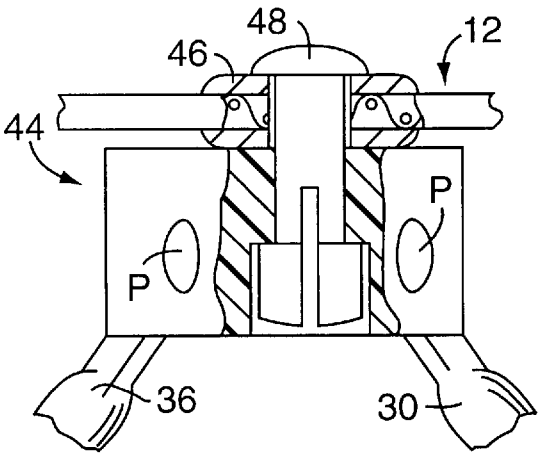
FIG. 10 is a somewhat enlarged fragmentary front elevational view of the seat front support assembly.

The upper end portions of the consecutively positioned adjacent linkages 22–26 are pivotally connected to each other by upper or seat support members which include a pair of rear seat support members 42, 42 and a front seat support member 44. The rear seat support members 42, 42 are structurally similar to the previously mentioned feet 40, 40 however, the rear seat support members 42, 42 have apertures 43, 43 for slideably receiving the rear frame members 20, 20 therethrough and are free to slide axially along the latter members, for a purpose which will be hereinafter further evident. The seat support member 42 which pivotally connects an upper end of the first side linkage 22 to the rear linkage 24 is shown in FIGS. 7–9. An upper or seat front support member 44 pivotally connects the upper ends of the first and second linkages 22 and 26 at the front of the chair frame 16 and differs somewhat from the rear seat supporting members 42, 42. The seat front support assembly which includes the seat front support 44 is shown in FIGS. 10–11.

The illustrated chair 10 has a generally triangular footprint defined by the three feet 40, 40. The seat 12 is generally triangular and may be made from any suitable flexible sheet material, a woven fabric being presently preferred. The illustrated seat 12 has reinforcing webbing sewn along its peripheral edge and disposed on its underside, as best shown in FIG. 1, wherein the reinforcing webbing is indicated at 45. The generally triangularly shaped seat 12 is further reinforced at each apex or corner and has a grommet 46 attached thereto in the region of each corner. The grommets 46, 46 at the rear corners of the seat 12 are received on the rear members 20, 20' to slide freely therealong. The rear corners of the seat rest upon the seat rear support members 42, 42. The front corner of the triangular seat rests upon the seat front support member 44 and is pinned to the front seat support member by a headed fastener 48 which snaps into engagement with the latter member.

The backrest 14 is also made from a durable flexible sheet material, a woven fabric being presently preferred. In accordance with presently preferred construction, the backrest is formed from a single sheet of fabric folded onto itself and to form two layers containing padding therebetween. Downwardly open pockets at opposite ends of the backrest 14 receive the free upper end portions of the upright rear members 20, 20' which comprise the backrest supports. Preferably, and as best shown in FIG. 2, the backrest 14 is secured to the upright members 20, 20' by threaded fasteners indicated at 50, 50.

The carrying or shoulder strap 18 essentially comprises an elongated flexible strap, preferably formed from webbing, and has opposite ends connected to the forward upper end portions of the first and second side linkages 22 and 26, that is portions of the linkages forward of the central pivot axis P thereof. In the illustrated embodiment 10 one end portion of the strap 18 is looped around the upper end portion of the link member or rod 30 forward of the link member central pivot P. The opposite end of the strap 18 is connected to the upper end portion of the link member or rod 36 forward of its associated central pivot axis P, as best shown in FIG. 3. The latter end of the strap is formed in a loop about the link member 36 and is secured to itself by an adjustable buckle 52. Thus, the strap 18 has an adjustable length. It should also be noted that the connected ends of the strap are free to slide along the upper portions of the link members 30 and 36 to which the end portions are connected. The end portion of the carrying strap 18 associated with the first side linkage 22 is preferably threaded across the outer side of the link member 28 and extends outwardly through the rear of the chair frame between the upright member 20 and the upper portion of the rear link member 34. In like manner the opposite end portion of the strap 18, that is the end portion connected to the second side linkage 26, passes over the outer-side of the link member 38 and passes outwardly through the rear of the chair frame between the upright member 20' and the upper end portion of the rear link 32, as best shown in FIG. 2.

The strap 18 is threaded through a pair of loops or eyes carried by the backrest 14 and formed by strips of material 56, 56 sewn or otherwise secured to the rear surface of the chair backrest, as best shown in FIG. 2. Preferably, and as best shown in FIG. 2, a shoulder pad 58 is provided on the strap 18. The shoulder pad 58 is located on a central portion of the carrying strap exposed at the rear of the chair 10 and between the loops formed by the strips 56,56.

Figure 12:
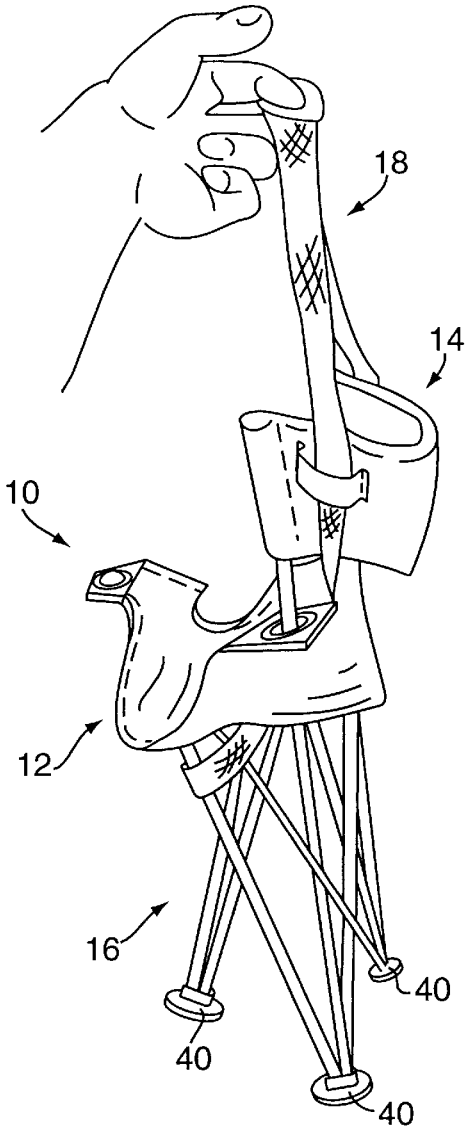
FIG. 12 is a somewhat reduced perspective view showing the chair in a partially collapsed position.
Figure 13:
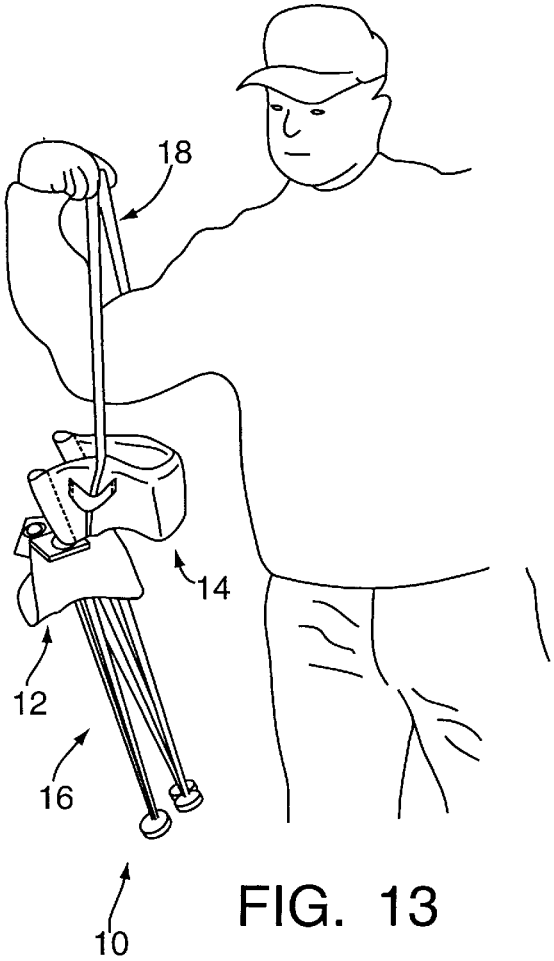
FIG. 13 is a somewhat further reduced perspective view similar to FIG. 12 but showing the chair in a fully collapsed position and being brought to a shoulder carrying position.

When the chair 10 is in its open or setup position, as it appears in FIGS. 1–3, the central portion of the strap 18, which includes the shoulder pad 58, is conveniently located proximate the rear surface of the backrest 14, as shown in FIG. 2. The chair 10 is moved from its open or seating position to its collapsed or carrying position by gripping the central portion of the carrying strap proximate the shoulder 15 pad 58, that is generally midway between the loops 56,56, and applying an upwardly directed lifting force to the carrying strap 18 to lift the chair 10 from its supporting surface. The carrying strap 18 may then be slung over the shoulder and brought to a shoulder carrying position with the same hand and arm motion used to lift and collapse the chair. In FIG. 12 the chair is shown suspended by the carrying strap in a partially collapsed condition. FIG. 13 shows the chair in a fully collapsed condition as the carrying strap is being brought to a shoulder carrying position. In the collapsed position all of the rigid elongated members which comprise the chair frame 16 extend generally in a single longitudinal direction (generally vertically) and form a compact bundle, substantially as shown. Thus, the chair may be conveniently carried on one shoulder leaving both hands free to carry such other items as may be desired.

Figure 14:
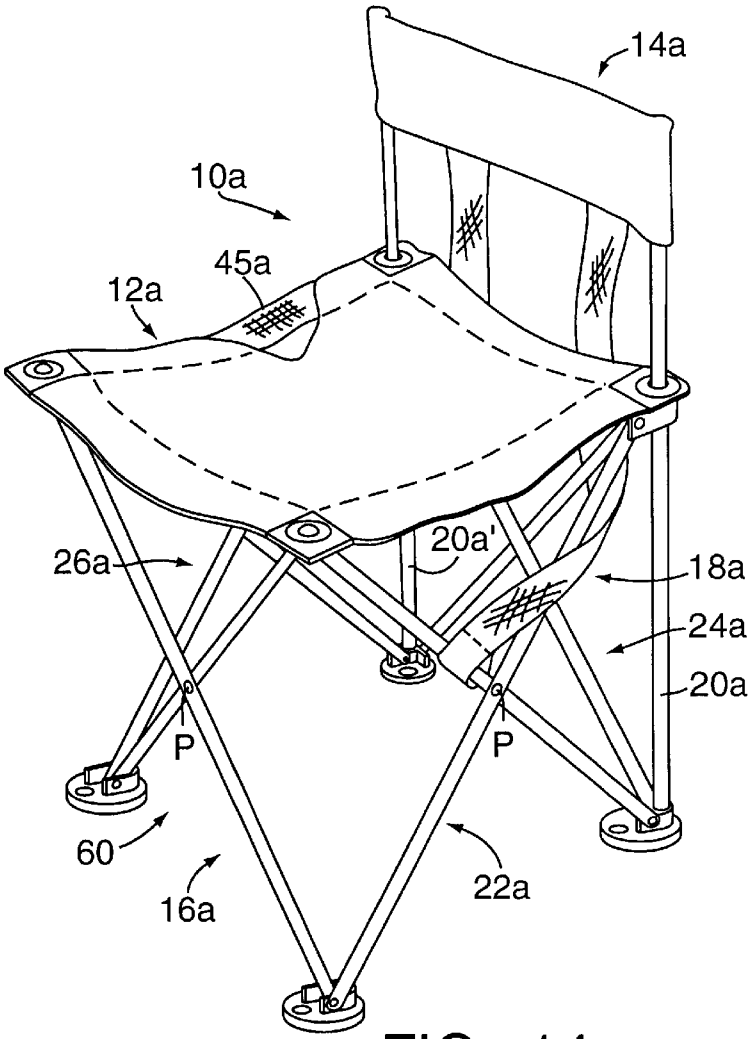
FIG. 14 is a fragmentary perspective view showing another chair embodying the present invention.

The portable collapsible chair 10 hereinbefore described and which has a triangular seat and three feet provides strength and durability in a structure of minimal size and weight. However, a person of large stature may prefer a chair which has a somewhat larger seating area. Such a chair, which embodies the present invention, is illustrated in FIG. 14 and indicated generally by the reference numeral 10*a*. The illustrated chair 10*a* is similar is most respects to the previously described chair 10. However, it differs from the chair 10 in that it has a generally rectangular seat and four feet which give the chair a generally rectangular footprint. Like the chair 10, the chair 10*a* has a chair frame 16*a* which includes upwardly extending rear members 20*a*, 20*a*' and a plurality of X-shaped linkages. However, it will be noted that the chair 10*a* has four such X-shaped linkages consecutively positioned adjacent one another. Thus, the chair 10*a* has a first side linkage 22*a*, a rear linkage 24*a*, a second side linkage 26*a* and a front linkage 60 which has no counterpart in the previously described structure. However, the construction of the two chairs 10 and 10*a* is otherwise substantially similar. The differences essentially reside in the angular positions of the pivotal connections between the feet 40*a*, 40*a* and the lower ends of the linkages and the seat supports 42*a*, 42*a* and 44*a*, 44*a* which provide the pivotal connections between the upper ends of the various linkages. The two chairs 10 and 10*a* fold to collapsed position and are carried in substantially the same manner.

Figure 15:
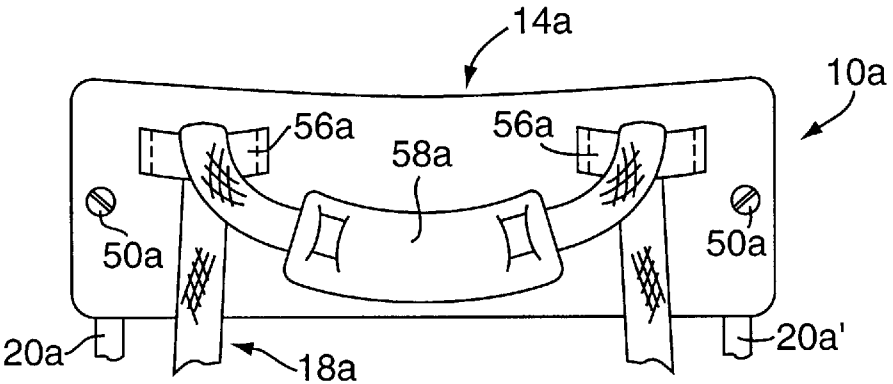
FIG. 15 is a fragmentary rear view of the chair shown in FIG. 14.

FIG. 15 is a fragmentary rear elevational view of chair 10*a*. As in the previously disclosed embodiment, the backrest 14*a* is preferably made from a durable flexible sheet material, such as a woven fabric. Downwardly open pockets at opposite ends of the backrest 14*a* receive the free upper end portions of the upright members which comprise the backrest supports. The backrest 14*a* is secured to the upright members by threaded fasteners indicated at 50*a*, 50*a*.

The carrying strap 18*a* is threaded through a pair of loops or eyes at the rear of the backrest 14*a*. The eyes are formed by sewing or otherwise securing strips of material, indicated at 56*a*, 56*a*, to the rear surface of the chair backrest 14*a*, as shown in FIG. 15. The illustrated embodiment includes a shoulder pad 58*a* located on a central portion of the carrying strap 18*a* and exposed at the rear of the chair 10*a* between the eyes formed by the strips 56*a*, 56*a* mounted on the rear surface of the backrest 14*a*. Opposite end portions of the carrying strap 18*a* are connected to opposite sides of the articulated chair frame 10*a* and cause the chair 10*a* to move from its setup position to its collapsed condition in response to lifting force applied to the central portion of the carrying strap 18*a*.

I claim:

1. A portable collapsible chair comprising an articulated chair frame having at least three X-shaped linkages consecutively positioned adjacent one another and including a rear linkage and a pair of side linkages, each of said linkages having a pair of rigid elongated link members, the link members of each pair being connected to each other at a central axis of the pair for pivotal movement relative to each other about the central axis, each of said link members having a lower portion terminating at a lower end and an upper portion terminating at an upper end, lower supporting means for connecting adjacent lower ends of consecutive linkages for pivotal movement relative to each other, upper supporting means for connecting adjacent upper ends of consecutive linkages for pivotal movement relative to each other, a flexible seat supported by said upper supporting means, the chair having a setup position wherein it rests upon a general horizontally disposed supporting surface with the seat supported in a generally horizontally disposed position, the chair having a collapsed position wherein the chair forms a compact bundle with each of the rigid elongated members generally extending in a single longitudinal direction, and carrying means for moving the chair from its setup position to its carrying position, maintaining the chair in its collapsed position, and carrying the chair in its collapsed position, the carrying means including an elongated carrying strap having strap end portions connected to the side linkages, the carrying strap extending rearwardly beyond the chair frame and having a strap central portion disposed rearward of the chair frame, portions of the carrying strap being slideably engageable with the link members of the rear linkage in response to an upwardly directed force applied to said strap central portion to lift the chair from its setup position whereby to move the chair to its collapsed position.

2. A portable collapsible chair as set forth in claim 1 wherein each of the strap end portions is connected to the upper portion of an associated one of the link members.

3. A portable collapsible chair as set forth in claim 2 wherein each of the strap end portions is connected for sliding movement along the upper end portion of the associated one of the link members.

4. A portable collapsible chair as set forth in claim 2 wherein each of the strap end portions is connected to the upper portion of an associated one of the link members forward of the central axis of the associated one of the link members.

5. A portable collapsible chair as set forth in claim 1 wherein each of the portions of the carrying strap is slideably engageable with an upper portion of an associated one of the link members of the rear linkage.

6. A portable collapsible chair as set forth in claim 1 wherein said chair frame includes a pair of rear frame members and said chair includes a backrest supported on said rear frame members.

7. A portable collapsible chair frame as set forth in claim 6 wherein said backrest has a pair of spaced apart eyes thereon and said carrying strap extends through said eyes.

8. A portable collapsible chair as set forth in claim 7 wherein said backrest comprises flexible sheet material.

9. A portable collapsible chair as set forth in claim 7 wherein said eyes are disposed at the rear of said backrest and the strap central portion is disposed generally between the eyes and adjacent a rear surface of the backrest when the chair is in its setup position.

10. A portable collapsible chair as set forth in claim 1 wherein said lower supporting means comprise a plurality of chair feet equal in number to said X-shaped linkages.

11. A portable collapsible chair as set forth in claim 10 wherein said chair frame has three X-shaped linkages and said seat has a generally triangular configuration.

12. A portable collapsible chair as set forth in claim 10 wherein the chair frame has four X-shaped linkages and the seat has a generally rectangular configuration.

13. A portable collapsible chair comprising a chair frame having at least 3 X-shaped linkages consecutively positioned adjacent one another and including a rear linkage and a pair of side linkages, each of said linkages having a pair of elongated link members, each of said link members of said pair being connected to the other at a central point of connection for pivotal movement about a central axis relative to said other, each of said members having a lower portion terminating at a lower end and an upper portion terminating at an upper end, lower supporting means for connecting adjacent lower ends of consecutive linkages for pivotal movement relative to each other, upper supporting means for connecting adjacent upper ends of consecutive linkages for pivotal movement relative to each other, a flexible seat supported by said upper supporting members, said chair having a setup position wherein it rests upon a generally horizontally disposed supporting surface with said seat supported in a generally horizontally disposed position, said chair having a collapsed carrying position wherein said chair forms a compact bundle with each of said elongated members generally extending in a single longitudinal direction, and carrying means including an elongated flexible carrying strap connected to said side linkages, said strap having a central carrying portion exposed rearwardly of said chair frame, said chair being movable from its setup position to its collapsed carrying position in response to upwardly directed force applied to said carrying portion to lift said chair from its setup position.

14. A portable collapsible chair comprising an articulated chair frame having a pair of axially elongated rigid rear members extending generally axially upward in parallel relation to each other when the chair is resting on a generally horizontally disposed supporting surface in its setup position, said rear members having lower portions defining rear legs and upper portions defining chair back supports, said chair frame including at least three consecutively positioned cross-linkages including a rear cross linkage disposed generally between said rear members and a pair of side cross linkages, each of said linkages including a pair of link members pivotally connected to each other at a central crossing point defining a central axis of the linkage, each of said link members having an upper portion terminating at an upper end and a lower portion terminating at a lower end, lower supporting means including a plurality of feet equal in number to said cross linkages and connecting adjacent lower ends of said link members for pivotal movement relative to each other, said feet including a pair of rear feet, each of said rear members being engaged with a respectively associated one of said rear feet, upper supporting means including a plurality of upper supporting elements equal in number to said cross linkages for connecting the upper ends of adjacent link members for pivotal movement relative to each other and including a pair of upper rear supporting elements, each of said rear supporting elements having an aperture receiving a respectively associated rear member therethrough, said rear supporting elements being supported for movement along and relative to said rear members, a flexible seat supported on said upper supporting elements, a flexible backrest supported on the chair back supports, the chair having a setup position wherein it rests upon a general horizontally disposed supporting surface with the seat supported in a generally horizontally disposed position, the chair having a collapsed position wherein the chair forms a compact bundle with each of the rigid elongated members generally extending in a single longitudinal direction, and carrying means for moving the chair from its setup position to its collapsed position, maintaining the chair in its collapsed position and carrying the chair in its collapsed condition, said carrying means including an elongated carrying strap having strap end portions connected to the side linkages, the carrying strap extending rearwardly beyond the chair frame and having a strap central portion disposed rearward of the chair frame, portions of the carrying strap being engageable with the link members of the rear linkage in response to an upwardly directed lifting force applied to said strap central portion when the chair is in its setup position to move the chair to its collapsed position.

15. A portable collapsible chair as set forth in claim 14 wherein the chair includes a pair of eyes mounted in spaced apart relation to each other on a rear surface of the flexible backrest and said carrying strap extends through said eyes.

16. A portable collapsible chair as set forth in claim 14 wherein said chair includes three cross-linkages and said seat has a generally triangular configuration.

17. A portable collapsible chair as set forth in claim 14 wherein the chair frame has four cross-linkages and the seat has a generally rectangular configuration.

18. A portable collapsible chair having a setup position and a collapsed position and comprising; an articulated chair frame having axially elongated rigid rear members and at least three consecutively positioned cross-linkages including a pair of side cross-linkages, each of said cross-linkages including a pair of axially elongated rigid link members connected to each other at a crossing point defining a cross-linkage axis, each of said link members having an upper portion terminating at an upper end and a lower portion terminating at a lower end, lower supporting means for connecting said lower end of each of said link members to said lower end of a consecutive one of said link members for pivotal movement relative to said lower end of said consecutivly positioned one of said linkages, and upper supporting means for connecting said upper end of each of said link members to said upper end of a consecutively positioned one of said link members for pivotal movement relative to said upper end of said consecutive one of said link members, seating means for supporting a person in a seated position on said chair including a flexible seat portion supported by said upper supporting means and a flexible backrest portion supported by said rear members when said chair is in its setup position, wherein said chair is adapted to rest on a generally horizontally disposed supporting surface, a pair of eyes at the rear of said backrest portion, said eyes being generally horizontally spaced apart when said chair is in its setup position, and carrying means for moving said chair from said setup position wherein said chair is adapted to rest on a generally horrizontal supporting surface to said collapsed position wherein said chair forms a compact bundle with said axially elongated rigid rear members and link members disposed in the same general direction of extent, carrying said chair in said collapsed positions and maintaining said chair in its collapsed position while it is being carried by said carrying means, said carrying means including a flexible carrying strap threaded through said eyes and having opposite end portions connected to said frame at opposite sides of said frame, said carrying strap having a central portion exposed at the rear of said chair between said eyes, said chair being movable from its setup position to its collapsed position in response to an upwardly directed lifting force applied to said central portion of said carrying strap when said chair is in its setup position.

19. A portable collapsible chair as set forth in claim 18 wherein said eyes comprise strips of flexible material having spaced apart end portions secured to the rear surface of the flexible backrest.

20. A portable collapsible chair as set forth in claim 18 wherein said chair includes three cross-linkages and said seat has a generally triangular configuration.

21. A portable collapsible chair as set forth in claim 18 wherein the chair frame has four cross-linkages and the seat has a generally rectangular configuration.

* * * * *